United States Patent [19]

Watanabe et al.

[11] Patent Number: 4,792,647

[45] Date of Patent: Dec. 20, 1988

[54] SUSPENSION INSULATOR

[75] Inventors: Akihiro Watanabe, Hashima; Hiroshi Nozaki, Nagoya; Mitsuharu Okamoto, Kuwana, all of Japan

[73] Assignee: NGK Insulators, Ltd., Nagoya, Japan

[21] Appl. No.: 182,250

[22] Filed: Apr. 15, 1988

[30] Foreign Application Priority Data

Apr. 28, 1987 [JP] Japan ..... 62-105702

[51] Int. Cl.[4] ..... H01B 17/08

[52] U.S. Cl. ..... 174/182; 174/196

[58] Field of Search ..... 174/182, 189, 196

[56] References Cited

U.S. PATENT DOCUMENTS 1,958,880 5/1934 Arnold ..... 174/182

4,396,798 8/1983 Nozaki et al. ..... 174/196

FOREIGN PATENT DOCUMENTS 402689 12/1933 United Kingdom ..... 174/182

*Primary Examiner*—Laramie E. Askin

*Attorney, Agent, or Firm*—Parkhurst, Oliff & Berridge

[57] ABSTRACT

The disclosed insulator has an insulating member with a cylindrical core, a metal cap with a central hole of inside diameter D so that the core of the member is cemented to the central hole of the metal cap, and a metal pin cemented to the inside of the core of the member. The metal pin has a cemented rod portion with a diameter $d_1$ and a large-diameter portion with an outside diameter $d_2$ at an end buried in the core of the member. The diameters satisfy the conditions of $$(d_2-d_1)/d_1 \leqq 0.5$$

$$(D-d_2)/d_2 \leqq 1.8.$$

1 Claim, 4 Drawing Sheets

SUSPENSION INSULATOR

BACKGROUND OF THE INVENTION

1. Field of the Invention

This invention relates to a suspension insulator which is mainly used to form insulator strings to be supported by arms of transmission line towers. More particularly, the invention relates to a suspension insulator whose dimensions are in such a range that its size is reduced without weakening its tensile strength.

2. Related Art Statement

Referring to FIG. 5, a typical conventional suspension insulator uses an insulating member 1 having a shed 1*a* extending radially from a central core 1*c*. A metal cap 3 is firmly secured to the top of the core 1*c* by cement 2. The core 1*c* has a pin-receiving hole 1*d* formed therein so as to have a closed top, and sands 5 are deposited on the inner surface of the pin-receiving hole 1*d* and on the outer sufface of core 1*c*. A metal pin 4 is inserted to the inside of the core 1*c* and secured thereto by cement 2*a* (FIG. 4). In the example of FIG. 4, the metal pin 4 has a large-diameter portion 4*a* at that end thereof which is buried in the pin-receiving hole 1*d* of the insulating member 1 by the cement 2*a*. The metal pin 4 also has a buried rod portion 4*b* which is cemented to the pin-receiving hole 1*d*, too.

The inside diameter D of the metal cap 3 has been selected independently of the outside diameter $d_2$ of the large-diameter portion 4*a* of the metal pin 4 and the outside diameter $d_1$ of the buried rod portion of the metal pin 4. In other words, no special attention has been paid to the following ratios M1 and M2

$$M1=(d_2-d_1)/d_1,\ M2=(D-d_2)/d_2$$

Thus, the above-mentioned diameters D, $d_1$ and $d_2$ have been determined without considering the values of the ratios M1 and M2 which are defined above.

The inventors have found that neglect of hhe above ratios M1 and M2 is a cause of waste in design effort of suspension insulators and that such neglect hampers both the designing of efficient and proper dimensions of the suspension insulators and the size reduction of the suspension insulators.

SUMMARY OF THE INVENTION

Therefore, an object of the present invention is to facilitate efficient and poper design of suspension insulators by using the above ratios M1 and M2 in specific ranges. The inventors have found the specific ranges of the ratios M1 and M2 as outcome of years of their research and development efforts.

A suspension insulator according to the invention uses an insulating member having an annular shed with a cylindrical core formed at the central portion thereof. The core has a pin-receiving hole with a closed top formed on its central part. A metal cap with an inside diameter D is fitted on and cemented to the outer surface of the core of the insulating member, and a metal pin is cemented to the inside of the pin-receiving hole. That part of the metal pin which is cemented to the pin-receiving hole has a large-diameter portion with an outside diameter $d_2$ and a rod portion with an outside diameter $d_1$. The inside diameter D of the metal cap and the outside diameters $d_1$ and $d_2$ of the metal pin satify the conditions of $$(d_2-d_1)d_1 \leqq 0.5 \ldots \quad (1)$$

$$(D-d_2)/d_2 \leqq 1.8. \ldots \quad (2)$$

The suspension insulator satisfying the conditions of the above equations (1) and (2) maintains a high tensile strength even when its actual dimensions vary within the range of the equations. Thus, the size of the suspension insulators can be reduced without reducing their tensile strength.

BRIEF DESCRIPTION OF THE DRAWING

For a better understanding of the invention, reference is made to the accompanying drawing, in which.

Throughout different views of the drawings, the following symbols are used.

1: an insulating member,
1*a*: a shed,
1*b*: an under-rib,
1*c*: a core,
1*d*: a pin-receiving hole,
2, 2*a*: cement,
3: a metal cap,
4: a metal pin,
5: sands,
11: a detector,
12: a dial gauge,
13: a probe,
$d_1$: outside diameter of buried rod portion 4*b* of the metal pin 4,
$d_2$: outside diameter of large-diameter portion 4*a* of the metal pin 4,
D: inside diameter of the metal cap 3,
R1: inside radius of the metal cap 3, and
R2: outside radius of the metal cap 3.

DESCRIPTION OF THE PREFERRED EMBODIMENT

An embodiment of the suspension insulator of the invention will be described now by referring to FIG. 1 through FIG. 5.

Figure 5:
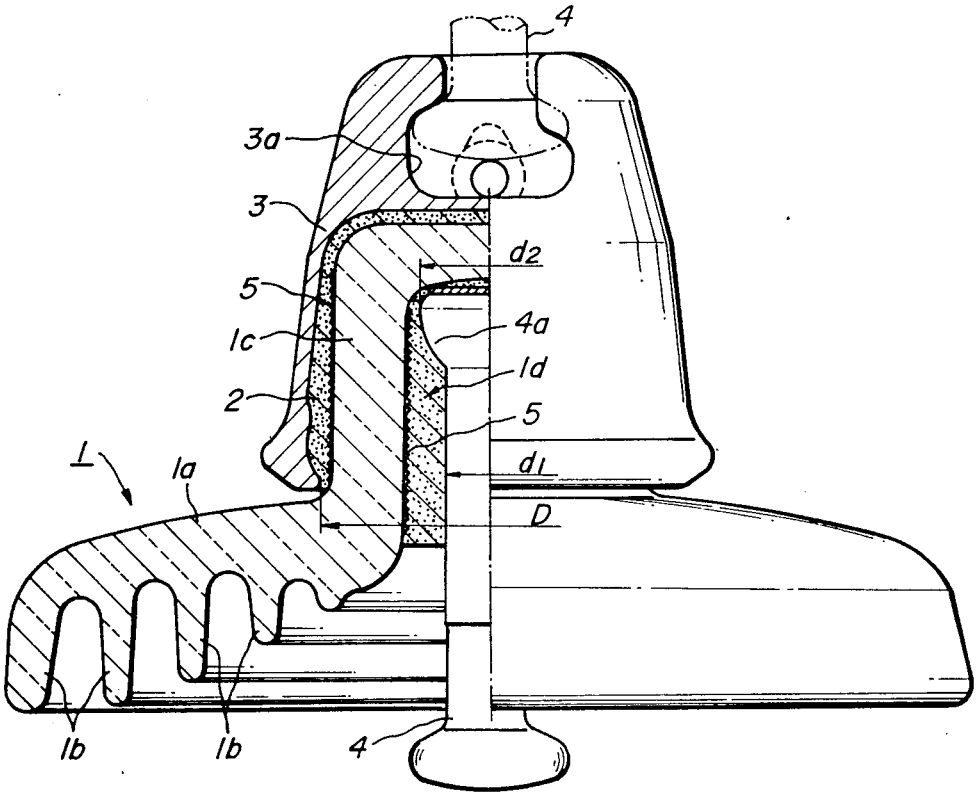
FIG. 5 is a partially cutaway side view of a suspension insulator.

Referring to FIG. 5, an insulating member 1 of the suspension insulator has a central core 1*c* of hollow cylindrical shape with a closed top, a shed 1*a* extending radially from the core 1*c*, and a plurality of annular under-ribs 1*b* depending from the lower surface of the shed 1*a* in a concentric manner. A metal cap 3 is firmly secured onto the outer surface of the core 1*c* by cement 2 so as to cover the core 1*c*. A socket 3*a* is formed on the top portion of the metal cap 3 so that the lower end of a metal pin 4 of another suspension insulator immediately above fits in the socket 3*a*. The upper portion of each metal pin 4 is firmly secured to the inside of the core 1*c* by cement 2*a*. The lower end of the metal pin 4 of each suspension insulator may fit in the socket 3*a* of the metal cap 3 of another suspension insulator immediately below. Thus, a number of suspension insulators can be connected by the pin-socket engagement so as to form an insulator string.

Sands 5 are deposited on the inner surface and outer surface of the core 1*c* of the insulating member 1, so as to provide a strong mechanical bondage of the metal cap 3 and the metal pin 4 to the core 1*c* by cementing.

Figure 4:
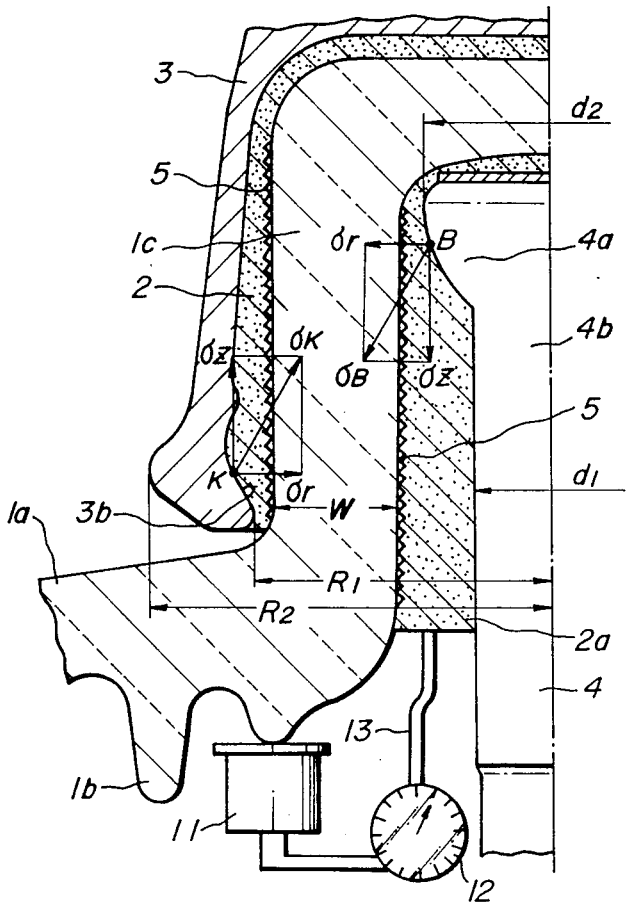
FIG. 4 is a partial vertical sectional view of the core portion of a suspension insulator.

Referring to FIG. 4, when a tensile load is applied across the metal cap 3 and the metal pin 4 of the suspension insulator, "wedge effect" is caused by the combination of a tapered surface of the large-diameter portion 4*a* of the metal rod 4 and a tapered surface of lower end inward portion 3*b* of the metal cap 3. More specifically, a horizontal load component $\sigma_r$ and a vertical load component $\sigma_z$ are generated at a point B on the tapered surface of the metal pin 4, so as to produce a synthesized load $\sigma_B$ there. Similarly, a horizontal load component $\sigma_r$ and a vertical load component $\sigma_z$ are generated at a point K on the tapered Surface of the metal cap 3, so as to produce a synthesized load $\sigma_K$ there. Such synthesized loads apply a compression to the core 1*c* of the insulating member 1 (to be referred to as porcelain hereinafter) through the cement layers 2, 2*a*.

The cement 2*a* between the porcelain core 1*c* and the metal pin 4, as shown in FIG. 4, displaces depending on the above-mentioned vertical load component $\sigma_z$. The resistance against such displacement of the cement 2*a* can be strengthened by increasing the horizontal load component $\sigma_r$ at the point K of the metal cap which is called "hooping effect" of the metal cap.

To check the displacement of the cement 2*a*, a detector 11 may be fixed to the lower surface of the porcelain shed 1*a* as shown in FIG. 4. The illustrated detector 11 has a dial gauge 12 driven by a probe 13 whose tip is kept in contact with the lower end surface of the cement 2*a*. When a tensile load is applied to the metal pin 4, the detector 11 measures the displacement of the lower end surface of the cement 2*a* due to such tensile load.

The horizontal load component $\sigma_r$ at the point K increases with the tensile load. However, when the load surpasses the elastic limit of the metal cap 3, the "hooping effect" fails rapidly, and the resistance against the vertical load component $\sigma_z$ at the point B is lost.

Thus, as long as the mechanical properties of the material of the metal cap 3 are kept the same, loading limit for the "hooping effect" can be raised by reducing the inside diameter D of the metal cap 3 (due to a similar reason to the fact that a thick-wall cylinder exposed to an inner pressure can withstand a higher pressure with reduction of its inside diameter). Accordingly, the tensile strength of the porcelain of the suspension insulator can be improved by reducing the inside diameter D of the metal cap 3. This means that the outside diameter of the core 1*c* of the porcelain can be reduced.

Figure 2:
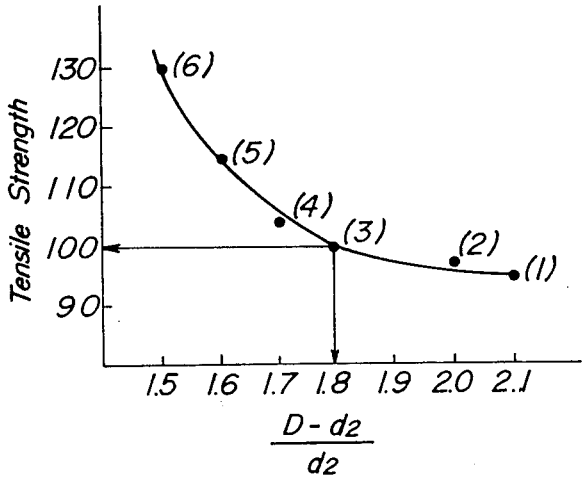
FIG. 2 is a graph showing the relatinship between the tensile strength of a suspension insulator and the ratio $(D-d_2)/d_2$, D being the inside diameter of a metal cap of the insulator and $d_2$ being the outside diameter of a large-diameter portion of the metal pin.
Figure 3:
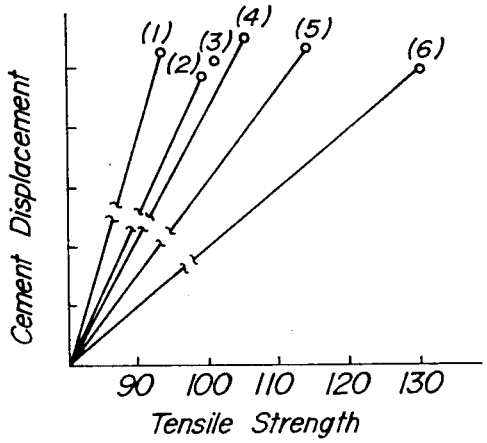
FIG. 3 is a graph showing the relationship between the tensile strength of a suspension insulator and displacement of its cement layer for six specimens with different dimensional ratios of parts.

The inventors carried out experiments to check the variation of the tensile strength of the suspension insulator for different inside diameters D of the metal cap 3, namely for different wall thickness W (FIG. 4) of the core 1*c*. In the experiments, six specimens (1) through (6) were made, in which the outside diameter d1 of the buried rod portion 4*b* and the outside diameter d2 of the large-diameter portion 4*a* of the metal rod 4 were kept constant. FIG. 2 shows the result. The experiments proved that the tensile strength of the suspension insulator increases with the reduction of the inside diameter D of the metal cap 3, namely with the reduction of the ratio $M2=(D-d_2)/d_2$.

Measurement was taken on the relationship between the tensile strength and the cement displacement in the above specimens (1) through (6) of the suspension insulator. The resultiis shown in FIG. 3.

The reason for the increase of the tensile strength with the reduction of the above-mentioned ratio M2 appears to be as follows: namely, If the metal cap 3 of the suspension insulator is assumed to be a thick-wall cylinder subjected to an inside pressure P1, its radial deformation of the metal cap U for the inside pressure P1 is given by $$U=P_1\{(1+\gamma)h^2(1-\gamma)\}R_1/E(h^2-1)=P_1R_1/E\{(1+\gamma)+2/h_2-1\} \quad (3)$$

here,

E: modulus of elasticity $\gamma$: Poisson's ratio $h=R_2/R_1$ $R_2$: outside radius of the metal cap $R_1$: inside radius of the metal cap.

The above-mentioned "hooping effect" is the reaction to the inside pressure $P_1$ of the equation (3). If it is assumed that plastic breakdown occurs when the ratio $U/R_1$ reaches a certain value provided that the wall thickness of the metal Cap 3 ($W=R_2-R_1$) and the modulus of elasticity E and the Poisson's ratio $\gamma$ are constant, then it can withstand against a larger inside pressure $P_1$ as the value $R_1$ becomes smaller. Thus, reduction of the cap inside radius $R_1(=D/2)$ contributes to the improvement of the "hooping effect" and to the increase of the tensile strength.

On the other hand, the "wedge force" of the metal pin 4 can be increased by using a larger outside diameter $d_2$ of the large-diameter portion 4*a* (in this case, the "hooping effect" of the metal cap 3 also increases). However, the large outside diameter $d_2$ of the portion 4*a* inevitably results in a large inside diameter D of the metal cap 3 or an increase of the overall size of the suspension insulator.

To fulfill the object of the invention, i.e., size reduction of a suspension insulator without reduction in its tensile strength, in case the tensile strength index of 100 the tensile strength index of FIG. 22 is limited to be not smaller than 100 and the above-mentioned ratio M2 is required to be not larger than 1.8, namely $$(D-d_2)/d_2 \leqq 1.8 \ldots \quad (2)$$

Thus, dimensions which do not satisfy the equation (2) are eliminated from the invention.

Figure 1:
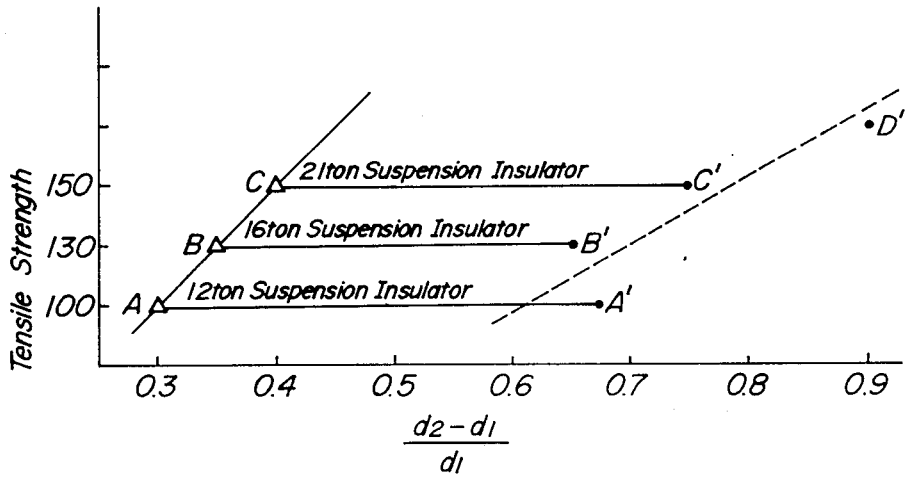
FIG. 1 is a graph showing the relationship between the tensile strength of a suspension insulator and the ratio $(d_2-d_1)/d_1$, $d_1$ being the outside diameter of the cemented rod portion of a metal pin of the insulator and $d_2$ being the outside diameter of a large-diameter portion of the metal pin.

The inventors also tested the effect of the above-mentioned ratio $M1=(d_2-d_1)/d_1$; namely, the ratio of the difference between the outside diameter $d_2$ of the large-diameter portion 4*a* and the outside diameter $d_1$ of the rod portion 4*b* to the rod portion outside diameter $d_1$. More specifically, the tensile strength of the suspension insulator with different values of the ratio M1 was messured, by using three specimens A, B and C of the invention and four reference specimens A', B', C' and D' of conventional suspension insulators. The ratio M1 of the specimens of the invention was less than 0.5, but the ratio M1 of the reference specimens was larger than 0.6. The result of the test is shown in FIG. 1.

It has been proved that even if the ratio M1 is small, i.e., even if the outside diameter $d_2$ of the large-diameter portion 4*a* of the metal rod 4 is comparatively small, sufficiently high tensile strength can be ensured as long as the conditions of the equation (2) are met. More particularly, the specimen A for the guaranteed strength 12 ton proved to have the same strength as that of the corresponding conventional specimen A' of larger size; the specimen B for the guaranteed strength 16 ton proved to have the same strength as that of the corresponding conventional specimen B' of larger size; and the specimen C for the guaranteed strength 21 ton proved to have the same strength as that of the corresponding conventional specimen C' of larger size.

Thus, when the outside diameters $d_1$ and $d_2$ of the metal pin 4 are so selected as to keep the abovementioned ratio M1 not larger than 0.5, namely to meet the conditions of $$(d_2-d_1)/d_1=0.5 \ldots \quad (1)$$

then the suspension insulator can be made smaller without reduction of its tensile strength.

It is noted here that the above-mentioned ratio M1 may be selected in a range of 0.5 to 1.0 and that the ratio M2 may be selected in a range of 1.8 to 2.0.

Figure 6:
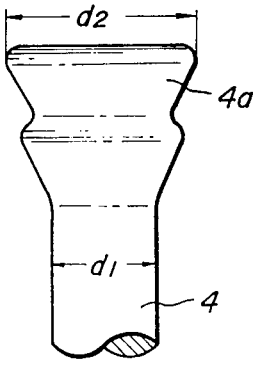
FIG. 6 is a partial side view of an example of the large-diameter portion of a metal pin.

In case of a multi-stepped large-diameter portion 4*a* of the metal pin 4, as shown in FIG. 6, its maximum diameter is taken as $d_2$ and its minimum diameter is taken as $d_1$ for the purpose of the application to the equations (1) and (2).

As described in detail in the foregoing, a suspension insulator according to the invention has a comparatively small metal cap and a comparatively small large-diameter portion of the metal rod provided that they satisfy the conditions of the equation (1) and (2), and yet the suspension insulator of the invention ensures a high tensile strength despite its reduced size. Thus, the invention contributes greatly to the industry by facilitating the proper dimensional design of the suspension insulator for size reduction, the saving of materials for the insulators, cost reduction of the insulators, and possible reduction of transmission line towers.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. A suspension insulator, comprising an insulating member having an annular shed with a cylindrical core formed at a central portion thereof, the core having a pin-receiving hole formed on the central part thereof, a metal cap with an inside diameter D fitted on and cemented to the outer surface of the core of the insulating member, and a metal pin cemented to the inside of the pin-receiving hole the cemented part of the pin in the pin-receiving hole having a large-diameter portion with an outside diameter $d_2$ and a rod portion with an outside diameter $d_1$, the inside diameter D of the metal cap and the outside diameters $d_1$ and $d_2$ of the metal pin satisfying conditions of $$(d_2-d_1)/d_1 \leqq 0.5$$

$$(D-d_2)/d_2 \leqq 1.8.$$

* * * * *